US007140708B2

(12) United States Patent
Lawrence et al.

(10) Patent No.: US 7,140,708 B2
(45) Date of Patent: Nov. 28, 2006

(54) METHOD OF EDGE-TO-EDGE IMAGING WITH AN IMAGING APPARATUS

(75) Inventors: Michael William Lawrence, Lexington, KY (US); Brian Keith Owens, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 303 days.

(21) Appl. No.: 10/929,309

(22) Filed: Aug. 30, 2004

(65) Prior Publication Data

US 2006/0044335 A1 Mar. 2, 2006

(51) Int. Cl.
*B41J 29/38* (2006.01)

(52) U.S. Cl. ..... 347/14; 347/19

(58) Field of Classification Search ..... None
See application file for complete search history.

(56) References Cited

U.S. PATENT DOCUMENTS

| | | | |
|---|---|---|---|
| 5,847,722 | A | 12/1998 | Hackleman |
| 5,961,226 | A | 10/1999 | Nishida |
| 5,997,129 | A | 12/1999 | Matsuhashi |
| 6,027,203 | A | 2/2000 | Campbell |
| 6,046,828 | A | 4/2000 | Feng et al. |
| 6,102,509 | A | 8/2000 | Olson |
| 6,109,745 | A | 8/2000 | Wen |
| 6,234,602 | B1 | 5/2001 | Soto et al. |
| 6,239,817 | B1 | 5/2001 | Meyer |
| 6,322,192 | B1 | 11/2001 | Walker |
| 6,325,505 | B1 | 12/2001 | Walker |
| 6,345,876 | B1 | 2/2002 | Tanaka et al. |
| 6,352,333 | B1 | 3/2002 | Matsumoto et al. |
| 6,386,663 | B1 | 5/2002 | Olson |
| 6,409,305 | B1 | 6/2002 | Elgee et al. |
| 6,457,803 | B1 | 6/2002 | Ohkoda |
| 6,527,360 | B1 | 3/2003 | Otsuki et al. |
| 6,575,554 | B1 | 6/2003 | Yoshinaga |
| 6,626,513 | B1 | 9/2003 | Adkins et al. |
| 6,682,097 | B1 | 1/2004 | Krauss et al. |
| 6,840,617 | B1 * | 1/2005 | Crosby et al. ..... 347/104 |
| 6,930,696 | B1 * | 8/2005 | Otsuki ..... 346/16 |
| 2003/0081057 | A1 | 5/2003 | Isono et al. |
| 2003/0095163 | A1 | 5/2003 | Otsuki et al. |
| 2003/0113152 | A1 | 6/2003 | Adkins et al. |
| 2003/0160837 | A1 | 8/2003 | Adkins et al. |
| 2003/0184634 | A1 | 10/2003 | Crosby et al. |
| 2003/0189611 | A1 | 10/2003 | Fan et al. |
| 2004/0017443 | A1 | 1/2004 | Ikeda et al. |
| 2004/0046829 | A1 | 3/2004 | Taguchi et al. |
| 2004/0056917 | A1 | 3/2004 | Su et al. |

* cited by examiner

*Primary Examiner*—Thinh Nguyen
(74) *Attorney, Agent, or Firm*—Taylor & Aust

(57) ABSTRACT

An edge-to-edge imaging method includes generating a reflectance profile of a mid-frame of an imaging apparatus by taking optical readings along the mid-frame with no print media present in a direction substantially orthogonal to the sheet feed direction, the reflectance profile distinguishing between the media support surface and the waste ink collection trough; taking optical readings across the mid-frame in the direction substantially orthogonal to the sheet feed direction with the sheet of print media present; comparing the optical readings taken with the sheet of print media present with the reflectance profile of the mid-frame; and applying an algorithm to adjust an amount of ink overspray along the lateral edges of the sheet of print media based on a result of the comparing.

16 Claims, 5 Drawing Sheets

METHOD OF EDGE-TO-EDGE IMAGING WITH AN IMAGING APPARATUS

BACKGROUND OF THE INVENTION

1. Field of the Invention

The present invention relates to an imaging apparatus, and, more particularly, to a method of edge-to-edge imaging with an imaging apparatus.

2. Description of the Related Art

An imaging apparatus forms an image on a sheet of print media, such as for example, paper or a transparency, by applying ink or toner onto the print medium. Such an imaging apparatus, in the form of an ink jet printer, forms an image on the sheet of print media by ejecting ink from a plurality of ink jetting nozzles of an ink jet printhead to form a pattern of ink dots on the print medium. Such an ink jet printer typically includes a reciprocating printhead carrier that transports one or more ink jet printheads across the sheet of print media that is supported by a mid-frame along a bi-directional scanning path defining a print zone of the ink jet printer.

For an ink jet printer that is capable of printing in an edge-to-edge mode, a waste ink collection trough, which may include one or more individual reservoirs, is used to capture waste ink along the edges of the sheet of print media in the print zone to prevent inking of the printer mid-frame. The trough is typically designed to be able to capture all of the waste ink that is ejected during edge-to-edge printing over the life of the printer. However, typically there is a physical limitation to the volume that can be used for the waste ink collection trough. If the waste ink collection trough fills completely, then the print quality will degrade to the point that the printer will need to be replaced due to ink smearing onto subsequent sheets of print media. Further, due to media location uncertainty, the edge-to-edge printing algorithm requires a worst-case overspray of ink to insure adequate coverage at the edges, i.e., leading, trailing and lateral edges, of the sheet of print media. For example, if the media size tolerance is +/−1 millimeter (mm) and the media location tolerance is +/−1 mm, then both of these tolerances are added together to determine how far beyond the nominal edge of the sheet of print media that the print swath needs to be extended, or stretched.

One attempt to reduce the amount of waste ink in edge-to-edge printing is to measure the sheet of print media to determine the dimensions of the sheet of print media before generating data for the print job. This measurement is performed by advancing the sheet of print media to a measurement location and then backing the paper up to a print start location prior to beginning the actual printing operation.

What is needed in the art is a method of edge-to-edge imaging with an imaging apparatus, which may dynamically determine the location of the lateral edges of a sheet of print media relative to the mid-frame of the imaging apparatus.

SUMMARY OF THE INVENTION

The present invention provides a method of edge-to-edge imaging with an imaging apparatus, which may dynamically determine the location of the lateral edges of a sheet of print media relative to the mid-frame of the imaging apparatus.

The present invention, in one form thereof, relates to an edge-to-edge imaging method implemented with an imaging apparatus that transports a sheet of print media in a sheet feed direction through a print zone. The imaging apparatus includes a mid-frame having a media support surface for supporting the print media in the print zone and having a waste ink collection trough formed in the mid-frame having at least two collection regions spaced to coincide with lateral edges of the sheet of print media. The method includes generating a reflectance profile of the mid-frame by taking optical readings along the mid-frame with no print media present in a direction substantially orthogonal to the sheet feed direction, the reflectance profile distinguishing between the media support surface and the waste ink collection trough; taking optical readings across the mid-frame in the direction substantially orthogonal to the sheet feed direction with the sheet of print media present; comparing the optical readings taken with the sheet of print media present with the reflectance profile of the mid-frame; and applying an algorithm to adjust an amount of ink overspray along the lateral edges of the sheet of print media based on a result of the comparing.

An advantage of the present invention is that the lateral edges of the print media need not be determined prior to starting the print job, e.g., prior to generating data for the print job.

Another advantage is that the lateral edges of the media need not be detected, but rather, the potential media presence is determined by looking for the absence of the waste ink collection trough at discrete points along the mid-frame.

Another advantage is that there is no wait time for measuring before or during a print job.

Another advantage is that the life expectancy of the imaging apparatus is lengthened, since the waste ink collection troughs are not filled as quickly.

Another advantage is the reduction in ink smear by reducing the amount of ink overspray, e.g., ink misting, on the mid-frame.

Another advantage is that the method of the present invention can be performed in conjunction with a print job, so it does not effect throughput and can be done multiple times down the page to periodically readjust for sheet skew.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
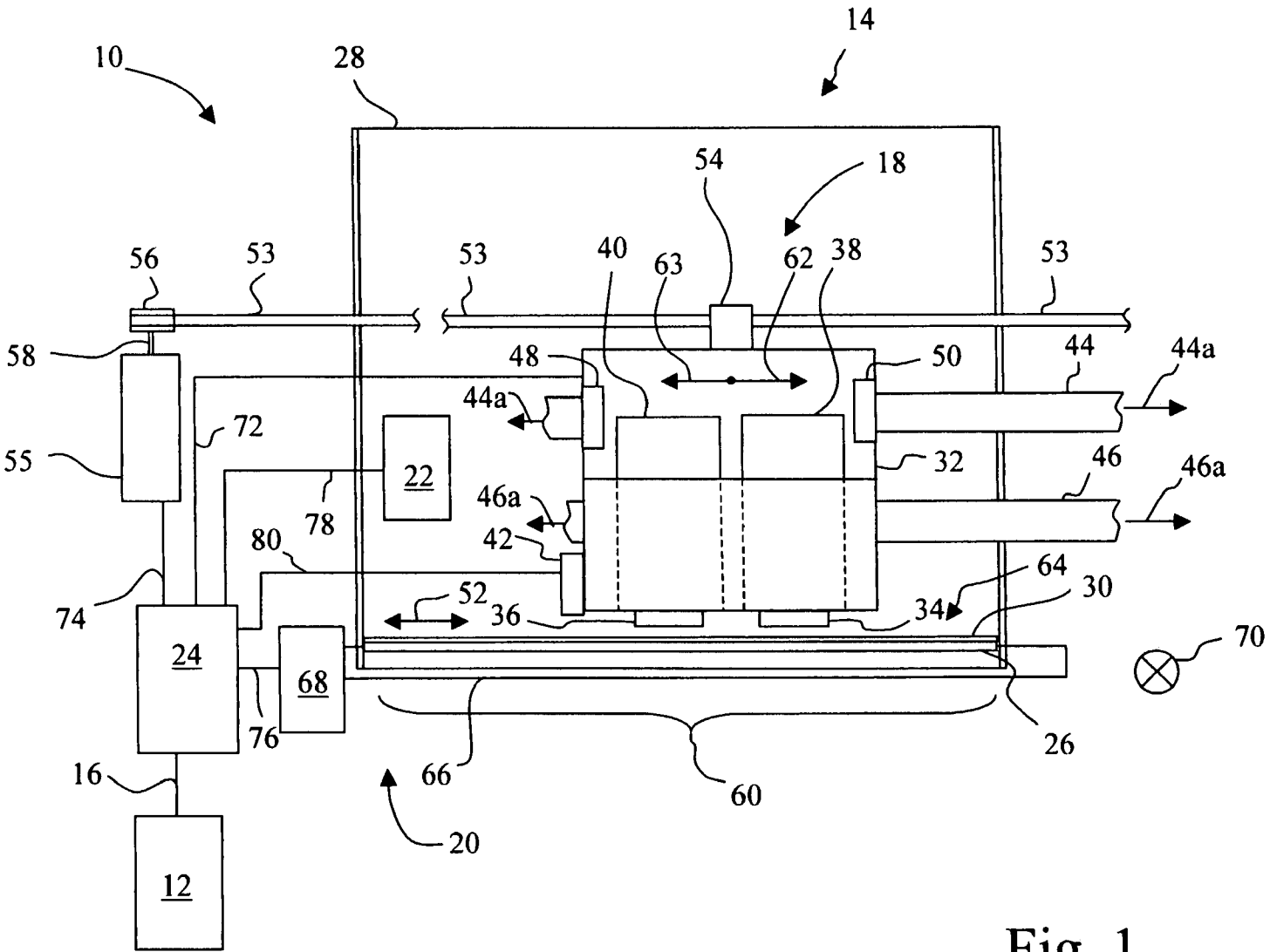
FIG. 1 is a diagrammatic depiction of an imaging system embodying the present invention.

Referring now to the drawings, and particularly to FIG. 1, there is shown an imaging system 10 embodying the present invention. Imaging system 10 may include a host 12, or alternatively, imaging system 10 may be a standalone system.

Imaging system 10 includes an imaging apparatus 14, which may be in the form of an ink jet printer, as shown. Thus, for example, imaging apparatus 14 may be a conventional ink jet printer, or may form the print engine for a multi-function apparatus, such as for example, a standalone unit that has faxing and copying capability, in addition to printing.

Host 12, which may be optional, may be communicatively coupled to imaging apparatus 14 via a communications link 16. Communications link 16 may be, for example, a direct electrical connection, a wireless connection, or a network connection.

In embodiments including host 12, host 12 may be, for example, a personal computer including a display device, an input device (e.g., keyboard), a processor, input/output (I/O) interfaces, memory, such as RAM, ROM, NVRAM, and a mass data storage device, such as a hard drive, CD-ROM and/or DVD units. During operation, host 12 includes in its memory a software program including program instructions that function as a printer driver for imaging apparatus 14. The printer driver is in communication with imaging apparatus 14 via communications link 16. The printer driver, for example, includes a halftoning unit and a data formatter that places print data and print commands in a format that can be recognized by imaging apparatus 14. In a network environment, communications between host 12 and imaging apparatus 14 may be facilitated via a standard communication protocol, such as the Network Printer Alliance Protocol (NPAP).

In the embodiment of FIG. 1, imaging apparatus 14, in the form of an ink jet printer, includes a printhead carrier system 18, a feed roller unit 20, a sheet picking unit 22, a controller 24, a mid-frame 26 and a media source 28.

Media source 28 is configured to receive a plurality of print medium sheets from which a print medium, i.e., a sheet of print media 30 having a print media surface 30*a*, is picked by sheet picking unit 22 and transported to feed roller unit 20, which in turn further transports the sheet of print media 30 during an imaging operation. The sheet of print media 30 may be, for example, plain paper, coated paper, photo paper or transparency media.

Printhead carrier system 18 includes a printhead carrier 32 for mounting and carrying a color printhead 34 and/or a monochrome printhead 36. A color ink reservoir 38 is provided in fluid communication with color printhead 34, and a monochrome ink reservoir 40 is provided in fluid communication with monochrome printhead 36. Those skilled in the art will recognize that color printhead 34 and color ink reservoir 38 may be formed as individual discrete units, or may be combined as an integral unitary printhead cartridge. Likewise, monochrome printhead 36 and monochrome ink reservoir 40 may be formed as individual discrete units, or may be combined as an integral unitary printhead cartridge.

Printhead carrier system 18 further includes a reflectance sensor 42 attached to printhead carrier 32. Reflectance sensor 42 may be, for example, a unitary optical sensor including at least one light source, such as a light emitting diode (LED), and at least one reflectance detector, such as a phototransistor. The reflectance detector is located on the same side of a media as the light source. The operation of such sensors is well known in the art, and thus, will be discussed herein to the extent necessary to relate the operation of reflectance sensor 42 to the operation of the present invention. For example, the LED of reflectance sensor 42 directs light at a predefined angle onto a surface to be read, such as a surface of mid-frame 26 and/or the surface of the sheet of print media 30, and at least a portion of light reflected from the surface is received by the reflectance detector of reflectance sensor 42. The intensity of the reflected light received by the reflectance detector varies with the reflectivity of the surface. The light received by the reflectance detector of reflectance sensor 42 is converted to an electrical signal by the reflectance detector of reflectance sensor 42. The signal generated by the reflectance detector corresponds to the reflectivity of the surface scanned by reflectance sensor 42. Thus, as used herein, the term "reflectivity" refers to the intensity of the light reflected from mid-frame 26 and/or the sheet of print media 30 scanned by reflectance sensor 42, which may be used in accordance with the present invention to dynamically determine the location of the lateral edges of the sheet of print media 30 relative to mid-frame 26 during edge-to-edge printing.

Printhead carrier 32 is guided by a pair of guide members 44, 46, which may be, for example, in the form of guide rods. Each of guide members 44, 46 includes a respective horizontal axis 44*a*, 46*a*. Printhead carrier 32 includes a pair of guide member bearings 48, 50, each of guide member bearings 48, 50 including a respective aperture for receiving guide member 44. The horizontal axis 44*a* of guide member 44 generally defines a bidirectional scan path 52 for printhead carrier 32. Accordingly, scan path 52 is associated with each of printheads 34, 36 and reflectance sensor 42.

Printhead carrier 32 is connected to a carrier transport belt 53 via a carrier drive attachment device 54. Carrier transport belt 53 is driven by a carrier motor 55 via a carrier pulley 56. Carrier motor 55 has a rotating carrier motor shaft 58 that is attached to carrier pulley 56. Carrier motor 55 can be, for example, a direct current (DC) motor or a stepper motor. At the directive of controller 24, printhead carrier 32 is transported in a reciprocating manner along guide members 44, 46, and in turn, along scan path 52.

The reciprocation of printhead carrier 32 transports ink jet printheads 34, 36 and reflectance sensor 42 across the sheet of print media 30, such as paper, along scan path 52 to define a print/sense zone 60 of imaging apparatus 14. The reciprocation of printhead carrier 32 occurs in a main scan direction (bidirectional) that is parallel with bi-directional scan path 52, and is also commonly referred to as the horizontal direction, including a left-to-right carrier scan direction 62 and a right-to-left carrier scan direction 63. Generally, during each scan of printhead carrier 32 while printing or sensing, the sheet of print media 30 is held stationary by feed roller unit 20.

Mid-frame 26 provides support for the sheet of print media 30 when the sheet of print media 30 is in print/sense zone 60, and in part, defines a portion of a print medium path 64 of imaging apparatus 14.

Feed roller unit 20 includes a feed roller 66 and corresponding index pinch rollers (not shown). Feed roller 66 is driven by a drive unit 68. The index pinch rollers apply a biasing force to hold the sheet of print media 30 in contact with respective driven feed roller 66. Drive unit 68 includes a drive source, such as a stepper motor, and an associated drive mechanism, such as a gear train or belt/pulley arrangement. Feed roller unit 20 feeds the sheet of print media 30 in a sheet feed direction 70, designated as an X in a circle to indicate that the sheet feed direction is out of the plane of FIG. 1 toward the reader. The sheet feed direction 70 is commonly referred to as the vertical direction, which is perpendicular to the horizontal bi-directional scan path 52, and in turn, is perpendicular to the horizontal carrier scan directions 62, 63. Thus, with respect to the sheet of print media 30, carrier reciprocation occurs in a horizontal direction and media advance occurs in a vertical direction, and the carrier reciprocation is generally perpendicular to the media advance.

Controller 24 includes a microprocessor having an associated random access memory (RAM) and read only memory (ROM). Controller 24 is electrically connected and communicatively coupled to printheads 34, 36 via a communications link 72, such as for example a printhead interface cable. Controller 24 is electrically connected and communicatively coupled to carrier motor 55 via a communications link 74, such as for example an interface cable. Controller 24 is electrically connected and communicatively coupled to drive unit 68 via a communications link 76, such as for example an interface cable. Controller 24 is electrically connected and communicatively coupled to sheet picking unit 22 via a communications link 78, such as for example an interface cable. Controller 24 is electrically connected and communicatively coupled to reflectance sensor 42 via a communications link 80, such as for example an interface cable.

Controller 24 executes program instructions to effect the printing of an image on the sheet of print media 30, such as for example, by selecting the index feed distance of the sheet of print media 30 along print medium path 64 as conveyed by feed roller 66, controlling the acceleration rate and velocity of printhead carrier 32, and controlling the operations of printheads 34, 36, such as for example, by controlling the fire time of individual nozzles of printhead 34 and/or printhead 36. As used herein, the term "fire time" is the time between firings of a nozzle of a printhead in forming adjacent dots on the same scan line of an image. In addition, controller 24 executes instructions, based on reflectance data received from reflectance sensor 42, to dynamically determine the location of the lateral edges of the sheet of print media 30 relative to mid-frame 26 during edge-to-edge printing, and adjust, e.g., minimize, an amount of ink overspray along the lateral edges of the sheet of print media 30.

Figure 2:
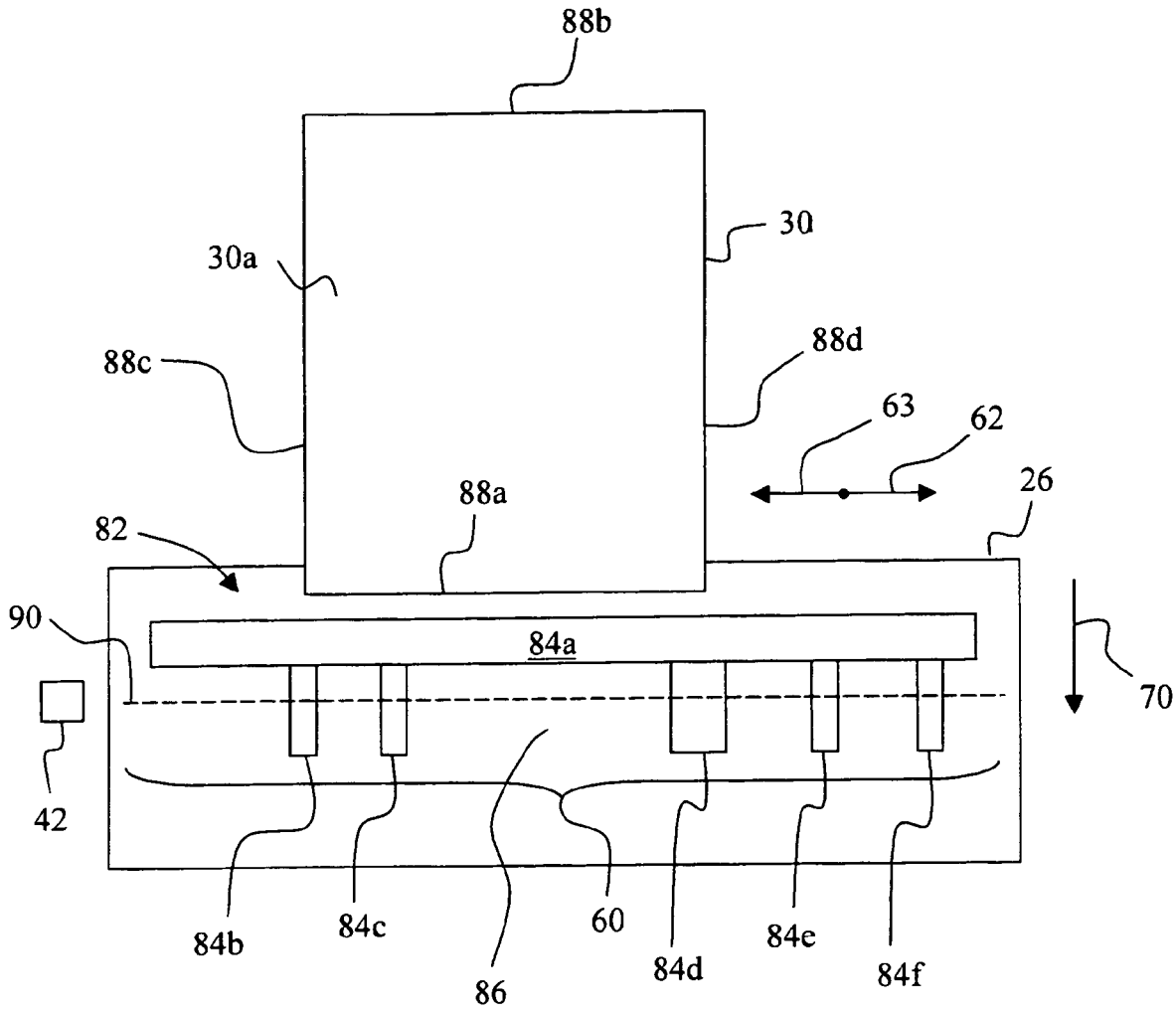
FIG. 2 is a diagrammatic top view of the mid-frame of the imaging apparatus of FIG. 1, including a waste ink collection trough.

FIG. 2 is a diagrammatic top view of mid-frame 26 of imaging apparatus 14. Mid-frame 26 includes a waste ink collection trough 82, including a plurality of recessed collection regions 84*a*, 84*b*, 84*c*, 84*d*, 84*e* and 84*f*, that is surrounded by a media support surface 86. The sheet of print media 30 includes a leading edge 88*a*, a trailing edge 88*b*, a first lateral edge 88*c*, and a second lateral edge 88*d*. During the edge-to-edge printing of the sheet of print media 30 depicted in FIG. 2, for example, overspray at leading edge 88*a* and trailing edge 88*b* will be collected along collection region 84*a*, overspray at first lateral edge 88*c* will be collected at collection region 84*b*, and overspray at second lateral edge 88*d* will be collected at collection region 84*d*.

FIG. 2 further shows a sensor scan path 90 of reflectance sensor 42, depicted as a dashed line, which is generally parallel to carrier scan directions 62, 63. As shown in FIG. 2, reflectance sensor 42 will transition between media support surface 86 and collection regions 84*b*, 84*c*, 84*d*, 84*e* and 84*f* of waste ink collection trough 82 as reflectance sensor 42 is transported by printhead carrier 32 (see FIG. 1) in one of carrier scan directions 62, 63.

Each of collection regions 84*b*, 84*c*, 84*d*, 84*e* and 84*f* of waste ink collection trough 82 may include features to deflect light, e.g., a sloped floor, to further decrease the amount of reflected light received by reflectance sensor 42 from trough 82 in relation to media support surface 86 of mid-frame 26, and thereby further distinguishing trough 82 from the media support surface 86 of mid-frame 26 in terms of reflected light.

Figure 3:
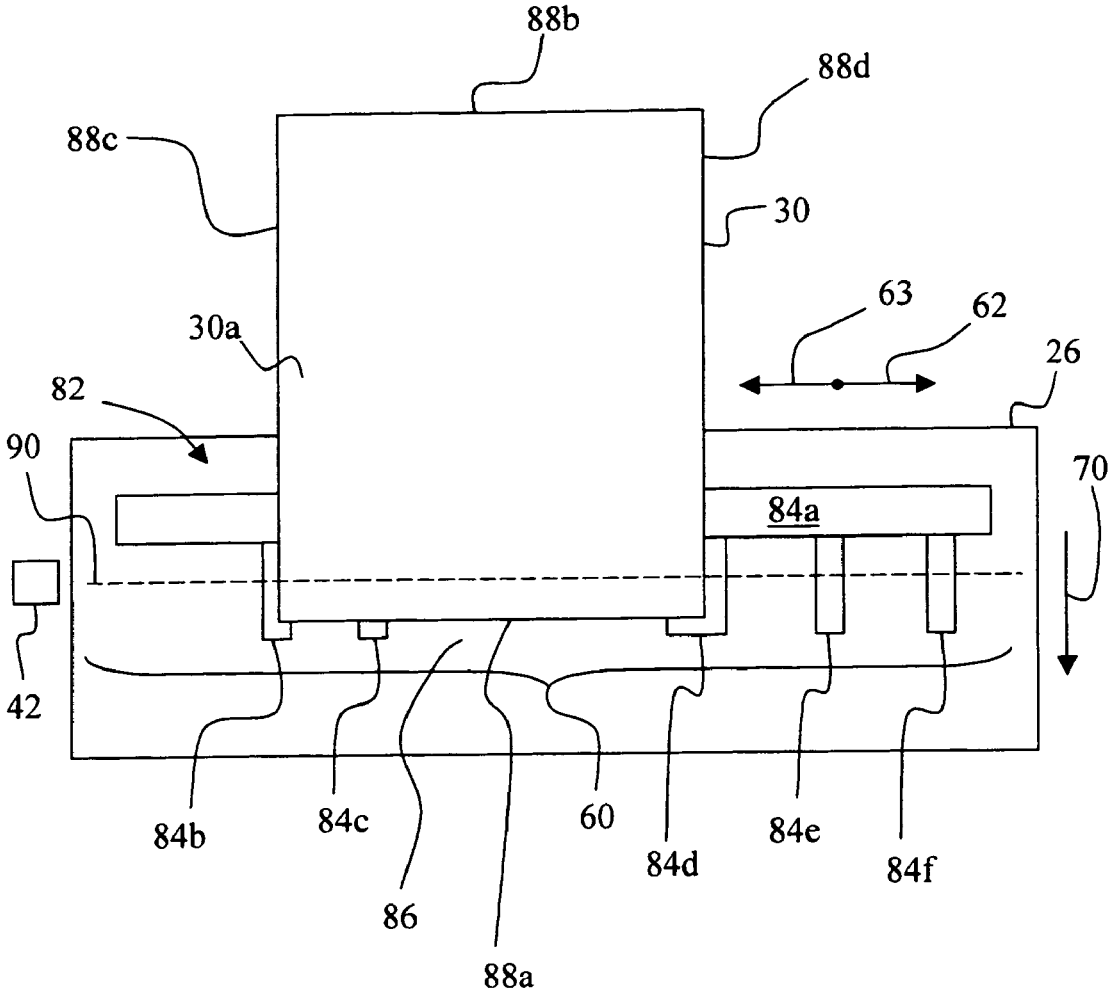
FIG. 3 is a diagrammatic top view of the mid-frame of the imaging apparatus of FIG. 1, with a sheet of print media present over a pair of collection regions of the waste ink collection trough shown in FIG. 2.

FIG. 3 shows a diagrammatic top view of mid-frame 26 of imaging apparatus 14, with the sheet of print media 30 present over a pair of collection regions 84*b*, 84*d* of the waste ink collection trough 82. As shown in FIG. 3, with reference to FIG. 2, for example, reflectance sensor 42 may transition over a portion of media support surface 86, a portion of collection region 84*b*, print media surface 30*a*, a portion of collection region 84*d*, another portion of media support surface 86, collection region 84*e*, another portion of media support surface 86, collection region 84*f*, and another portion of media support surface 86, respectively, as reflectance sensor 42 is transported by printhead carrier 32 (see FIG. 1) in carrier scan direction 62, left to right. To simplify the method, however, optical readings may be ended once reflectance sensor 42 detects the collection region of waste ink collection trough 82 that is adjacent the second encountered lateral edge of the sheet of print media 30.

Figure 4:
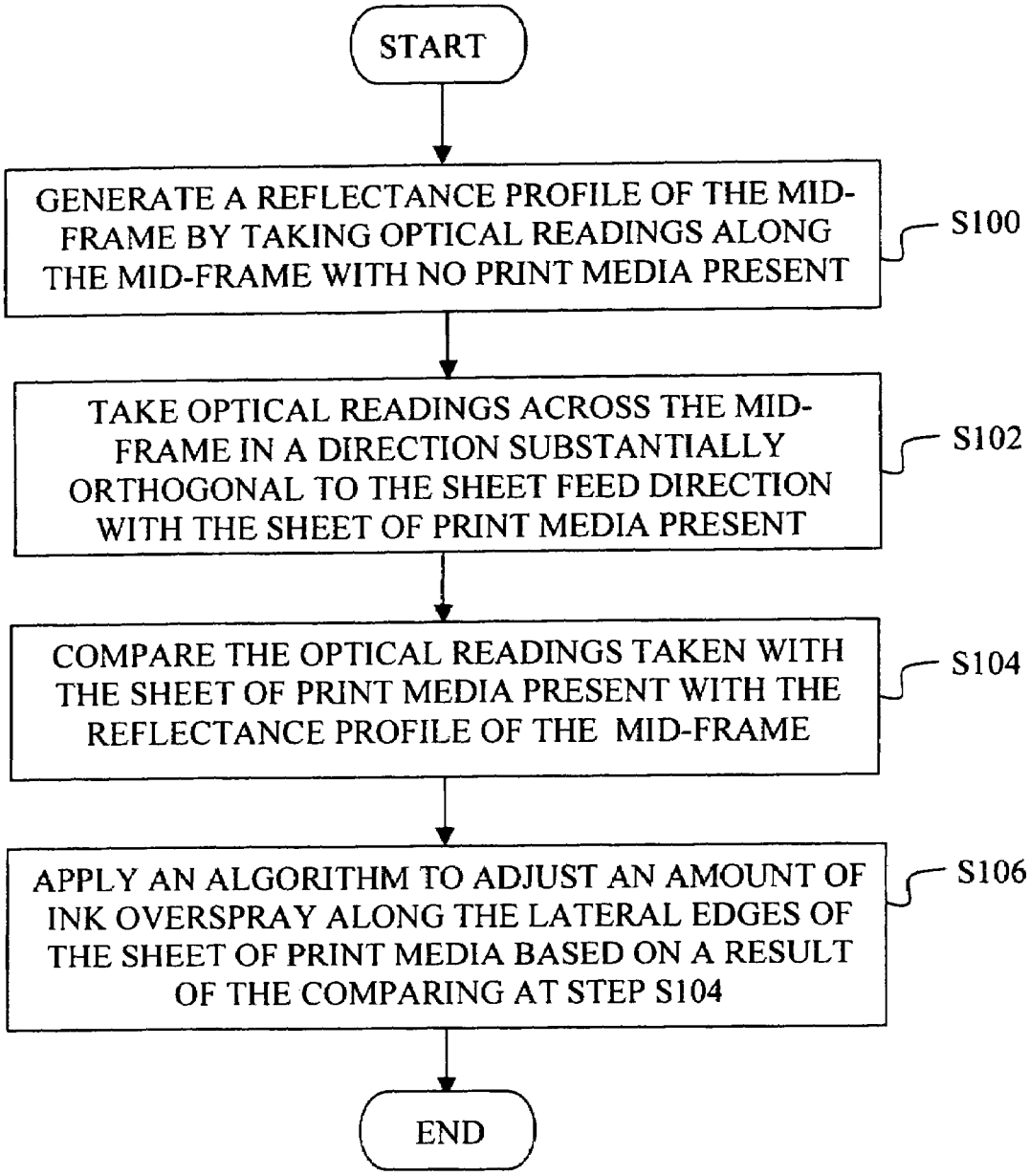
FIG. 4 is a flowchart depicting a general method of edge-to-edge imaging in accordance with the present invention.

FIG. 4 is a flowchart depicting a general method of edge-to-edge imaging in accordance with the present invention. The method of FIG. 4 may be implemented using controller 24 of imaging apparatus 14, which is configured via software and/or firmware to execute process instructions for performing the method.

At step S100, a reflectance profile of mid-frame 26 is generated by taking optical readings with reflectance sensor 42 with along mid-frame 26 with no print media present at sensor scan path 90 (see FIG. 2) in a direction, e.g., direction 62, substantially orthogonal to sheet feed direction 70. For example, a change of the reflectivity ($\Delta R$) may be detected, e.g., calculated, by controller 24, and correlated with one of media support surface 86 and waste ink collection trough 82. Thus, the reflectance profile distinguishes between media support surface 86 and waste ink collection trough 82. Such optical readings of media support surface 86 and waste ink collection trough 82 of mid-frame 26 may be made at Power-On of imaging apparatus 14, or prior to the start of a print job, when no print media is present in print/sense zone 60, to accurately locate the collection regions of waste ink collection trough 82.

Figure 5:
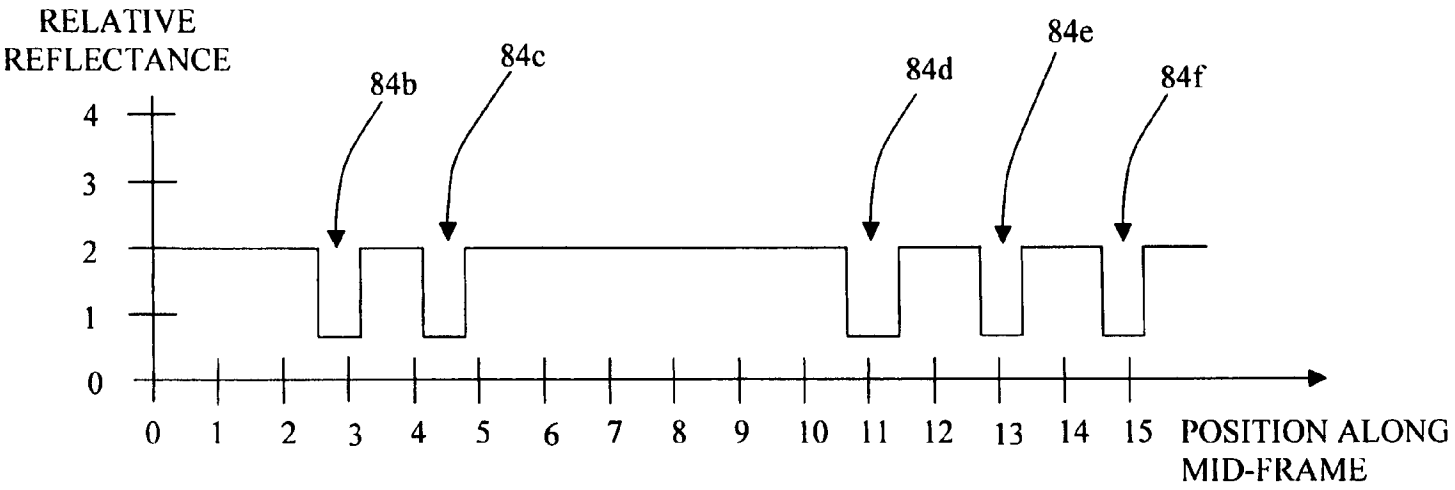
FIG. 5 is a graphical representation of a reflectance profile of the mid-frame of FIG. 2 with no sheet of print media present under the reflectance sensor.

An exemplary reflectance profile of mid-frame 26 is shown in FIG. 5. As shown in FIG. 5 with respect to FIG. 2, media support surface 86, which is present between collection regions 84*b*, 84*c*, 84*d*, 84*e* and 84*f* of waste ink collection trough 82, has a relative reflectance along mid-frame 26 which is higher than that of collection regions 84*b*, 84*c*, 84*d*, 84*e* and 84*f* of waste ink collection trough 82. In this example, the relative reflectance of media support surface 86 is 2, whereas the relative reflectance of collection regions 84*b*, 84*c*, 84*d*, 84*e* and 84*f* is about 0.5. The relative position along mid-frame 26 is represented by numerical indicators for convenience, with zero representing the left-most position on mid-frame 26 with regard to the orientation of mid-frame 26 shown in FIGS. 2 and 3. The reflectance profile of mid-frame 26 may be stored, for example, in a memory associated with controller 24.

At step S102, optical readings are taken with reflectance sensor 42 across mid-frame 26 in the direction, e.g., direction 62, substantially orthogonal to sheet feed direction 70 with the sheet of print media 30 present at sensor scan path 90. Reflectance sensor 42 may be used to take optical readings while printhead carrier 32 is moving at normal print speeds, in either of directions 62, 63.

Figure 6:
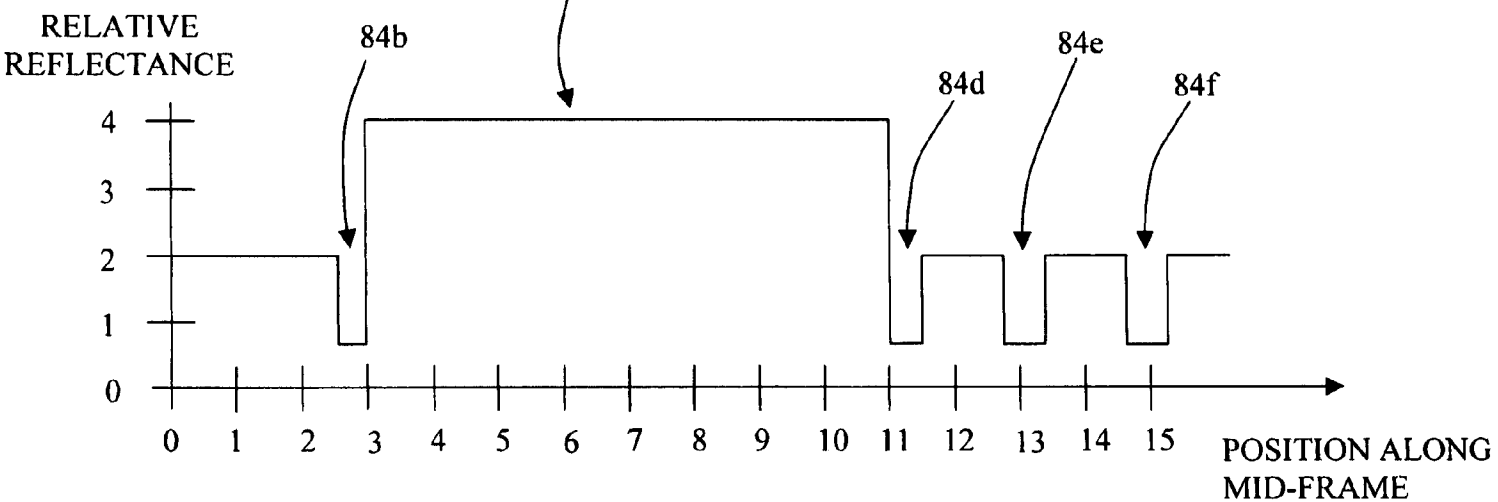
FIG. 6 is a graphical representation of optical readings taken across the mid-frame with the sheet of print media present under the reflectance sensor.

An exemplary reflectance profile of mid-frame 26 with the sheet of print media 30 present at sensor scan path 90 is shown in FIG. 6 with respect to FIG. 3. In this example, the relative reflectance of media support surface 86 is 2.0; the relative reflectance of collection regions 84*b*, 84*c*, 84*d*, 84*e* and 84*f* is about 0.5; and the relative reflectance of print media surface 30*a* of the sheet of print media 30 is 4.0. The relative position along mid-frame 26 is represented by numerical indicators for convenience, with the presence of lateral edges 88*c*, 88*d* of the sheet of print media 30 occurring at mid-frame positions 3 and 11 in this example. While this reflectance profile of mid-frame 26 may be stored, in one preferred embodiment, discrete optical measurements are intermittently made along mid-frame 26, e.g., in direction 62, and dynamically processed in accordance with step S104.

At step S104, the optical readings taken with the sheet of print media 30 present at step S102 are compared with the reflectance profile of mid-frame 26 taken at step S100. Thus, step S104 may be performed dynamically during a print job. For example, a change of the reflectivity (ΔR) may be detected, e.g., calculated, by controller 24, and may be processed directly in accordance with step S106, or may be stored in an associated memory. Alternatively, in embodiments including host 12, the change of the reflectivity (ΔR) may be detected by host 12, and processed accordingly.

At step S106, an algorithm is applied to adjust, e.g., minimize, an amount of ink overspray along the lateral edges 88*c*, 88*d* of the sheet of print media 30 (see FIG. 3) based on a result of the comparing of step S104.

In one exemplary algorithm, the first print swaths of printheads 34, 36 are generated using worst-case estimates for ink overspray, but once the sheet of print media 30 is detected by reflectance sensor 42, a modified algorithm may be used to minimize the overspray. For example, once the optical readings are taken, printing can be enabled to overspray at 0.5 mm or less into the respective collection region of trough 82. For example, if printhead carrier 32 is moving at 40 inches per second, reflectance sensor 42 may be capable of taking 10 readings (samples) per mm. However, the skew specification for the print media may not demand this level of accuracy, so a lower level of sampling may be used. Thus, for example, by taking only 4 optical readings per millimeter, it will be known every quarter millimeter if printhead carrier 32 is over the sheet of print media 30, over a collection region of waste ink collection trough 82, or over media support surface 86 of mid-frame 26. The overspray algorithm may be further modified to account for the mechanical tolerance between the printhead, e.g., printheads 34, 36, and reflectance sensor 42. These likely will be small numbers, but may be adjusted for each program if the minimum amount of overspray is desired.

Once the optical readings are taken (e.g., 4 readings per mm), the skew specification for the print media will determine how much overspray is required to insure media coverage. For example, if skew is a problem for a particular imaging apparatus, e.g., a printer, then multiple optical readings can be taken periodically at intervals along the sheet of print media 30 in sheet feed direction 70 to readjust the amount of overspray periodically as the sheet of print media 30 is advanced in sheet feed direction 70. The amount of overspray can be handled in firmware associated with controller 24 using the print swaths generated by either a printer driver resident on host 12 or the firmware and/or software associated with controller 24, in the case of a stand-alone copy operation.

For a system that has tight tolerances for print media skew, or that makes optical readings periodically at intervals along the sheet of print media 30 in sheet feed direction 70, the amount of overspray may be limited, for example, to 0.5 mm or less. For example, if a particular collection region of waste ink collection trough 82 is known to be 12 mm wide, this translates into 48 readings from reflectance sensor 42 that should read "trough". Referring to FIG. 3, if a set of optical readings are taken during a print job and there are, for example, only 22 readings of "trough", and the remainder (26) of the readings are significantly different, and it can be assumed that there is a sheet of print media over trough 82 that is interfering with the trough readings. In this case, to insure adequate ink coverage for an edge-to-edge print job at 0.5 mm, the print swath would need to extend by 0.5 mm at the point of transition, thereby providing for ink coverage of approximately 0.5 mm beyond the lateral edge of the sheet of print media 30. By limiting the overspray to 0.5 mm, the amount of ink buildup in waste ink collection trough 82 is significantly reduced over that of a system that oversprays, for example, by 1.0 mm.

Thus, one implementation of the present invention would be to limit the valid print locations to a maximum of two "trough" location readings by reflectance sensor 42 at each lateral edge of the sheet of print media 30. When taking optical readings that include the sheet of print media 30, the first two "trough" readings by reflectance sensor 42 before or after a lateral edge "media" optical reading would be considered valid for edge-to-edge print data. Other trough locations would not be considered valid, even if print data is generated for those locations, and no ink would be ejected.

In another implementation, if multiple longitudinally spaced optical readings are taken to account for skew, e.g., optical readings taken periodically at intervals along the sheet of print media 30 in sheet feed direction 70 as the sheet of print media 30 is advanced in sheet feed direction 70, then it is possible to further reduce overspray by limiting to only one "trough" reading that would need to be "printed", assuming that the mechanical tolerance between reflectance sensor 42 and the printhead will so accommodate this level of accuracy.

The determination of whether a print location is valid may be handled by a filter in the firmware and/or software associated with controller 24. For example, even if print swaths are originally generated to print 103 mm wide, if reflectance sensor 42 detects that the collection regions of waste ink collection trough 82 around the sheet of print media 30 would indicate only 101.5 mm swaths are necessary, then controller 24 can limit the actual ink fired to be 101.5 mm. The fire control block in the firmware can filter out the extra data generated as unnecessary.

It is contemplated that the overspray algorithm may also be used to help eliminate erroneously spraying of ink on mid-frame 26 if a paper jam occurs. For example, reflectance sensor 42 may be used to determine if there is print media present in print/sense zone 60. If reflectance sensor 42 does not detect media entering the print/sense zone 60, or possibly after printing a few swaths, then controller 24 can abort the print job and indicate a paper jam.

While this invention has been described with respect to embodiments of the present invention, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An edge-to-edge imaging method implemented with an imaging apparatus that transports a sheet of print media in a sheet feed direction through a print zone, said imaging apparatus including a mid-frame having a media support surface for supporting said print media in said print zone, and having a waste ink collection trough formed in said mid-frame having at least two collection regions spaced to coincide with lateral edges of said sheet of print media, the method comprising:

generating a reflectance profile of said mid-frame by taking optical readings along said mid-frame with no print media present in a direction substantially orthogonal to said sheet feed direction, said reflectance profile distinguishing between said media support surface and said waste ink collection trough;

taking optical readings across said mid-frame in said direction substantially orthogonal to said sheet feed direction with said sheet of print media present;

comparing said optical readings taken with said sheet of print media present with said reflectance profile of said mid-frame; and applying an algorithm to adjust an amount of ink overspray along said lateral edges of said sheet of print media based on a result of said comparing.

2. The method of claim 1, wherein said optical readings are taken using a reciprocating sensor.

3. The method of claim 1, wherein said generating said reflectance profile of said mid-frame is performed prior to starting a print job.

4. The method of claim 3, wherein said taking optical readings across said mid-frame in said direction substantially orthogonal to said sheet feed direction with said sheet of print media present is performed during said print job.

5. The method of claim 4, wherein said comparing is performed dynamically during said print job.

6. The method of claim 5, wherein said comparing is performed at intervals along said sheet of print media in said sheet feed direction.

7. The method of claim 1, wherein said generating said reflectance profile of said mid-frame, comprises:

determining a change of said reflectivity along said mid-frame; and correlating said change in said reflectivity to one of said media support surface and said waste ink collection trough.

8. The method of claim 1, wherein said optical readings are taken as a number of samples per a unit length, and said amount of ink overspray is set in terms of a number of said samples outside a lateral edge of said sheet of print media.

9. An imaging apparatus configured for implementing an edge-to-edge imaging method, said imaging apparatus including a mechanism for transporting a sheet of print media in a sheet feed direction through a print zone, said imaging apparatus including a mid-frame having a media support surface for supporting said print media in said print zone, and having a waste ink collection trough formed in said mid-frame having at least two collection regions spaced to coincide with lateral edges of said sheet of print media, said imaging apparatus including a controller for executing process instructions for performing the steps of:

generating a reflectance profile of said mid-frame by taking optical readings along said mid-frame with no print media present in a direction substantially orthogonal to said sheet feed direction, said reflectance profile distinguishing between said media support surface and said waste ink collection trough;

taking optical readings across said mid-frame in said direction substantially orthogonal to said sheet feed direction with said sheet of print media present;

comparing said optical readings taken with said sheet of print media present with said reflectance profile of said mid-frame; and applying an algorithm to adjust an amount of ink overspray along said lateral edges of said sheet of print media based on a result of said comparing.

10. The apparatus of claim 9, wherein said optical readings are taken using a reciprocating sensor.

11. The apparatus of claim 9, wherein said generating said reflectance profile of said mid-frame is performed prior to starting a print job.

12. The apparatus of claim 11, wherein said taking optical readings across said mid-frame in said direction substantially orthogonal to said sheet feed direction with said sheet of print media present is performed during said print job.

13. The apparatus of claim 12, wherein said comparing is performed dynamically during said print job.

14. The apparatus of claim 13, wherein said comparing is performed at intervals along said sheet of print media in said sheet feed direction.

15. The apparatus of claim 9, wherein said generating said reflectance profile of said mid-frame, comprises:

determining a change of said reflectivity along said mid-frame; and correlating said change in said reflectivity to one of said media support surface and said waste ink collection trough.

16. The apparatus of claim 9, wherein said optical readings are taken as a number of samples per a unit length, and said amount of ink overspray is set in terms of a number of said samples outside a lateral edge of said sheet of print media.

* * * * *